United States Patent [19]

Yanagawa et al.

[11] 4,171,899

[45] Oct. 23, 1979

[54] TRANSFER APPARATUS

[75] Inventors: Nobuyuki Yanagawa, Chigasaki; Tsutomu Watanabe, Tokyo; Kohji Suzuki; Manabu Mochizuki, both of Kawasaki; Hajime Oyama, Tokyo, all of Japan

[73] Assignee: Ricoh Co., Ltd., Japan

[21] Appl. No.: 854,319

[22] Filed: Nov. 23, 1977

[30] Foreign Application Priority Data

Dec. 13, 1976 [JP] Japan ..... 51-149939

[51] Int. Cl.[2] ..... G03E 15/00

[52] U.S. Cl. ..... 355/3 TR; 250/325; 355/3 CH; 361/225

[58] Field of Search ..... 355/3 TR, 3 TE, 3 CH; 250/324–326; 96/1.4, 1 C; 361/225

[56] References Cited

U.S. PATENT DOCUMENTS

| | | | |
|---|---|---|---|
| 3,409,768 | 11/1968 | Whitmore et al. | 355/3 CH |
| 3,841,892 | 10/1974 | Krause et al. | 96/1.4 X |
| 3,877,417 | 4/1975 | Jeromin | 355/3 TR |
| 4,053,769 | 10/1977 | Nishikawa | 250/324 |

*Primary Examiner*—R. L. Moses

*Attorney, Agent, or Firm*—McGlew and Tuttle

[57] ABSTRACT

A transfer apparatus is provided of the type in which a toner image formed on a photosensitive member is transferred onto a transfer or copy sheet. The apparatus is used in a copying machine of a so-called delivery type in which the sheet is conveyed using a sheet gripper. During the transfer of a toner image, the appartus applies a corona discharge to the rear side of the sheet which is of the opposite polarity from that of the toner image. The apparatus comprises a diaphragm member for restricting an opening of a transfer charger and disposed between the transfer charger and the photosensitive member, the diaphragm member being movable away from the photosensitive member as the sheet gripper passes between the transfer charger and the photosensitive member.

26 Claims, 16 Drawing Figures

TRANSFER APPARATUS

BACKGROUND OF THE INVENTION

The invention relates to a transfer apparatus used in copying machines.

A copying machine of the type in which a toner image formed on a photosensitive member is transferred onto a sheet is provided with a transfer charger which applies a corona discharge to the rear surface of the sheet which is of the opposite polarity from that of the toner in order to transfer the toner from the photosensitive member to the sheet and to maintain the sheet in close contact with the member. The transfer of toner and the close contact between the member and the sheet can be improved by disposing the transfer charger as close to the photosensitive member as possible. In a copying machine in which the sheet is conveyed while it is being held by a sheet gripper, there must be provided a sufficient clearance between the photosensitive member and the transfer charger to permit the passage of the sheet gripper, and this prevented the disposition of the transfer charger sufficiently close to the photosensitive member. As a consequence, a copying machine of this type suffered from a poor transfer quality of the toner image.

It is believed that the bonding force between the toner and the photosensitive member depends on the particle size, charge and mass of the individual toner particles, and hence varies from toner particle to toner particle. This results in a movement of the toner having a reduced bonding force with respect to the photosensitive member to a position on the sheet which is offset from an accurate position before the sheet is brought into contact with the photosensitive member because of the application of the corona discharge of the opposite polarity, from that of the toner, by the transfer charger. Consequently, the optical density will be reduced where an image is to be transferred, while the toner which initiated its movement before the intended transfer takes place will cause a background smearing of the sheet. Such difficulty can be avoided by providing a reduced opening in a shield casing of the transfer charger so that the corona discharge from the electrode thereof will be applied only to a region of the photosensitive member and the sheet which are in contact with each other. However, with conventional copying machines which employ a sheet gripper, the spacing required between the photosensitive member and the transfer charger to permit the passage of the gripper therethrough prevented the disposition of the transfer charger close to the photosensitive member as well as the provision of a physical diaphragm member which serves reducing the opening in the shield casing.

SUMMARY OF THE INVENTION

It is an object of the invention to provide a transfer apparatus having a diaphragm member for reducing the opening of the transfer charger and which is moved away from the photosensitive member as the sheet gripper moves into a transfer station where the sheet is brought into contact with the photosensitive member and which is moved close to the photosensitive member after the passage of the sheet gripper.

DETAILED DESCRIPTION OF PREFERRED EMBODIMENTS

Before describing the invention, an exemplary copying machine of an image transfer type and using a sheet gripper will be described to provide a background for application of the invention.

Figure 1:
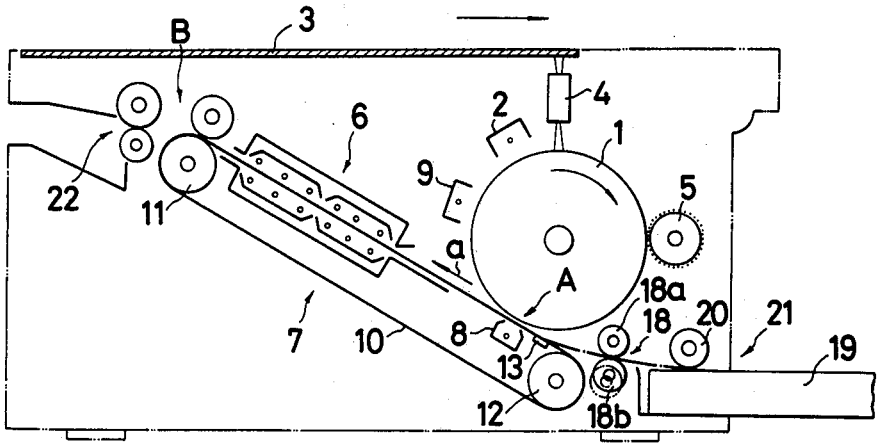
FIG. 1 is a schematic front view of an exemplary copying machine of an image transfer type and having a sheet conveying unit which employes a sheet gripper.

Referring to FIG. 1, there is shown a photosensitive member 1 in the form of a drum rotating in a direction indicated by an arrow. As is well recognized, a number of operative devices are disposed around the drum 1, including a charger 2 for charging the photosensitive member to a given polarity, for example, to the negative polarity; an exposure optical system 4 for transmitting the optical image of an original, not shown, disposed on an original receptacle 3 to the surface of the photosensitive member; a developing unit 5 for converting an electrostatic latent image, formed on the drum surface by the optical system, into a toner image using, for example, a toner which is charged to a positive potential; a sheet conveying unit which is disposed to be most close to the drum in a transfer station A to bring a sheet carried thereon into contact with the toner image to have it transferred thereto and which extends through a fixing unit 6 to have the toner image fixed, followed by delivery of the sheet; a transfer charger 8 for applying a corona discharge of the opposite polarity from that of the toner image; and a neutralizing charger 9 which provides a corona discharge to neutralize the drum subsequent to the transfer of the toner image.

Figure 2:
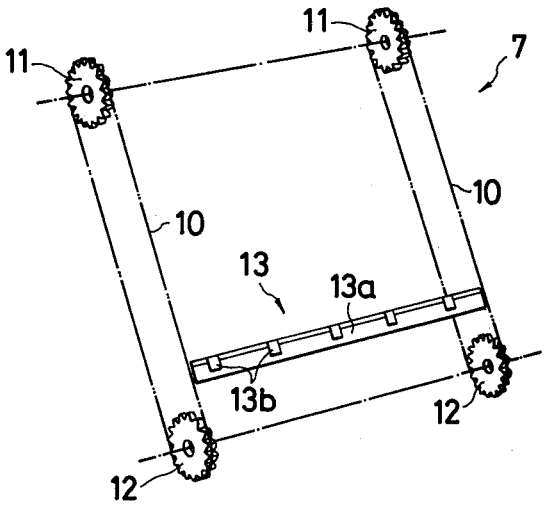
FIG. 2 is a schematic perspective view of the sheet conveying unit.

As shown diagrammatically in FIG. 2, the sheet conveying unit 7 comprises a pair of chains 10 which extend atround pairs of drive sprockets 11 and follower sprockets 12, and a sheet gripper 13 having its opposite ends secured to the chains and extending in a direction perpendicular to the length of the chains. The sheet gripper 13 moves in a direction indicated by an arrow a shown in FIG. 1, and is usually maintained stationary at a standby position located to the right of the transfer station A or rearwardly of the transfer charger 8, as viewed in the direction of travel thereof, for gripping the leading edge of a sheet as it is fed from a sheet feeder to be described later. The sheet gripper comprises a body 13*a* and a plurality of sheet retaining claws 13*b* which are urged toward the body 13*a* for gripping the leading edge of the sheet between the claws 13*b* and the body 13*a*.

A pair of auxiliary sheet conveying rollers 18, which comprises a drive roller 18*a* and a follower roller 18*b*, are disposed to the right of the standby position of the sheet gripper 13, as viewed in FIG. 1, and a sheet feeder 21 including a sheet cassette 19 and a feed roller 20 is disposed to the right of the auxiliary roller pair 18. The sheet cassette 19 contains a stack of copy sheets, which may be delivered, sheet by sheet, by the feed roller 20 toward the sheet gripper 13. The auxiliary roller pair 18 is arranged such that the follower roller 18*b* is removed from the drive roller 18*a*, as shown in chain lines, when the sheet is fed into the transfer station, but moves into the solid line position to feed the sheet as the sheet gripper 13 begins to move.

In operation of the copying machine shown in FIG. 1, when a print button, not shown, is depressed, the drum 1 starts to rotate in the direction indicated by the arrow, whereby the drum surface is sequentially charged by the charger 2. When the leading edge of an image forming region on the drum is located opposite to the exposure optical system 4, the receptacle 3 begins to move in a direction indicated by an arrow to project the image of the original placed thereon to the drum surface through the optical system 4. An electrostatic latent image formed on the drum surface is developed with a toner supplied by the developing unit 5, thus providing a toner image.

At the same time as the depression of the print button or a given time interval thereafter, the feed roller 20 rotates through one revolution to feed an uppermost sheet S located within the sheet cassette 19 toward the sheet gripper 13. As the leading edge of the region on the drum surface 1 in which the toner image is formed has rotated to reach the transfer station A, the sheet conveying unit 7 has already started and the sheet S gripped by the sheet gripper 13 is fed into the transfer station A.

As the sheet gripper 13 holding the sheet S passes through the transfer station A, the transfer charger 8 commences a corona discharge of the opposite polarity from that of the toner potential in order to transfer the toner image from the drum to the sheet S while holding the sheet tightly against the drum surface. After the completion of the transfer of the toner image, the drum 1 rotates under the neutralizing charger 9, whereby any residual potential is removed therefrom. The sheet S having the toner image transferred thereto is conveyed by the sheet conveying unit 7, and has its toner image fixed by heating while it passes through the fixing unit 6. After the fixing step, the sheet S is released from the gripper 13 at a develiery position B, and is delivered to the exterior of the machine by a pair of delivery rollers 22.

The transfer apparatus of the invention is adapted to be used in a copying machine of the type described above. Specifically, in accordance with the invention, the transfer apparatus comprises a diaphragm member 25 or 26 disposed between the transfer charger 8 and the photosensitive member or drum 1 for reducing the opening of the transfer charger as the sheet gripper approaches it, and for allowing the opening of the transfer charger, which is defined by the diaphragm member, to move close to the photosensitive member after the passage of the sheet gripper, thus allowing the transfer of the toner image to be achieved with a high quality.

Figure 3:
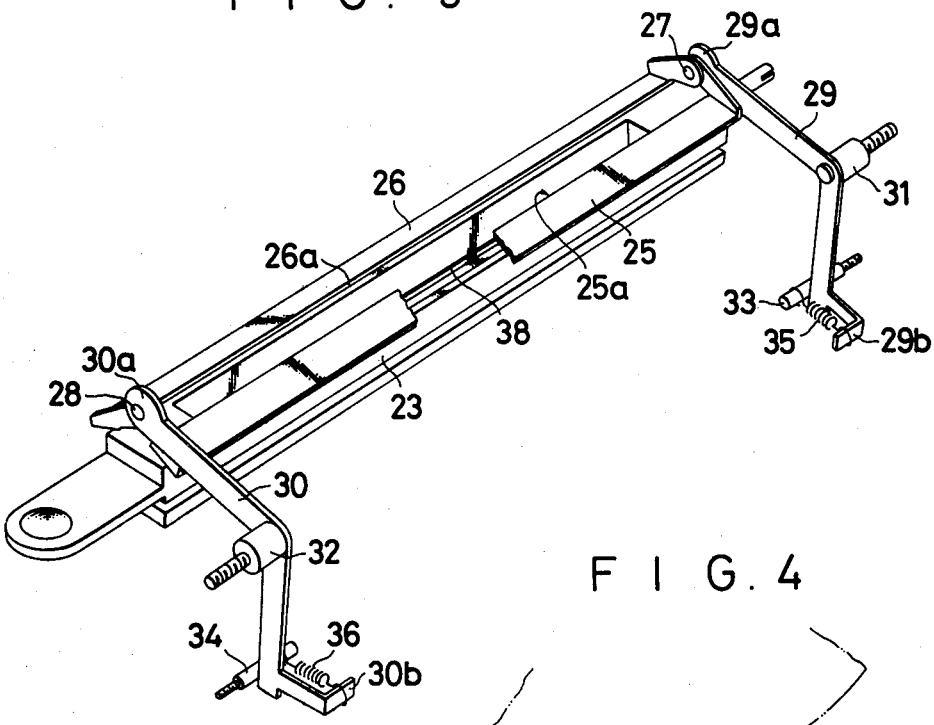
FIG. 3 is a perspective view of one embodiment of the invention.
Figure 4:
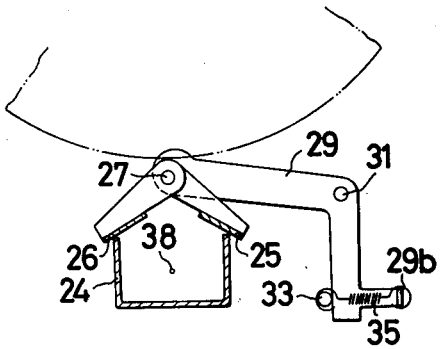
FIG. 4 is a front view, partly in section, of the apparatus shown in FIG. 3.
Figure 5:
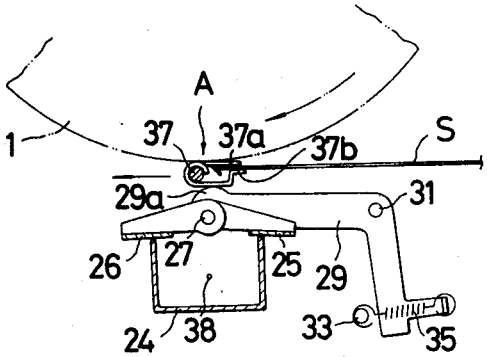
FIG. 5 is a similar view to FIG. 4, illustrating the operation thereof.

Referring to FIGS. 3 to 5, there is shown a transfer charger 23 including a shield casing 24, the opening of which is formed by a pair of diaphragm members 25 and 26 which are pivotally mounted on pins 27 and 28 respectively. The opposing edges 25*a*, 26*a* of the diaphragm members define the opening of the transfer apparatus. The pins 27, 28 are journaled on one end 29*a*, 30*a* of levers 29, 30, which are in turn rockably mounted on stepped screws 31,32 which are fixedly mounted on a stationary member, not shown, of the copying machine. The other end 29*b*, 30*b* of the levers 29, 30 are engaged by springs 35, 36, respectively, the other end of which is anchored to stops 33, 34 secured to the stationary member. The springs 35, 36 urge the levers 29, 30 to rotate clockwise about the screws 31 32, but the resulting rocking motion of the levers 29, 30 is limited by the abutment thereof against the stops 33, 34, as shown in FIG. 4 (only one stop being shown). When the levers 29, 30 bear against the stops 33, 34, the diaphragm members 25, 26 fall by gravity, to a position in which their one side is disposed in abutment against the opposite edges of the shield casing 24, as shown in FIG. 4.

Subsequently when a sheet gripper 37 comparable to gripper 13 shown in FIG. 1 and, which have the sheet S held between the sheet retaining claws 37*a* and body 37*b*, moves into the transfer station A, it bears against the end 29*a* of the levers 29, 30 as shown in FIG. 5 (only the end 29*a* being shown), thus lowering it. As a result, the lever 29 rocks counterclockwise against the resilience of the spring 35. The rocking motion of the lever 29 also lowers the pins 27, 28 (only one being shown) for the disphragm members 25, 26, which are therefore driven into a more flattened form, thus moving away from the drum surface. It will be noted that the end 29*a*, 30*a* of the levers 29, 30 thus functions as a cam follower, considering the sheet gripper as a cam.

When the sheet gripper 37 has moved past the transfer station A in the direction of the arrow after lowering the diaphragm members 25, 26, the levers 29, 30 return to their original position shown in FIG. 4 under the action of the respective springs 35, 36. Hence the diaphragm members 25, 26 also return to their original positions to reduce the opening of the shield casing 24, preventing an unnecessary diffusion of the corona discharge from the electrode 38.

Figure 6:
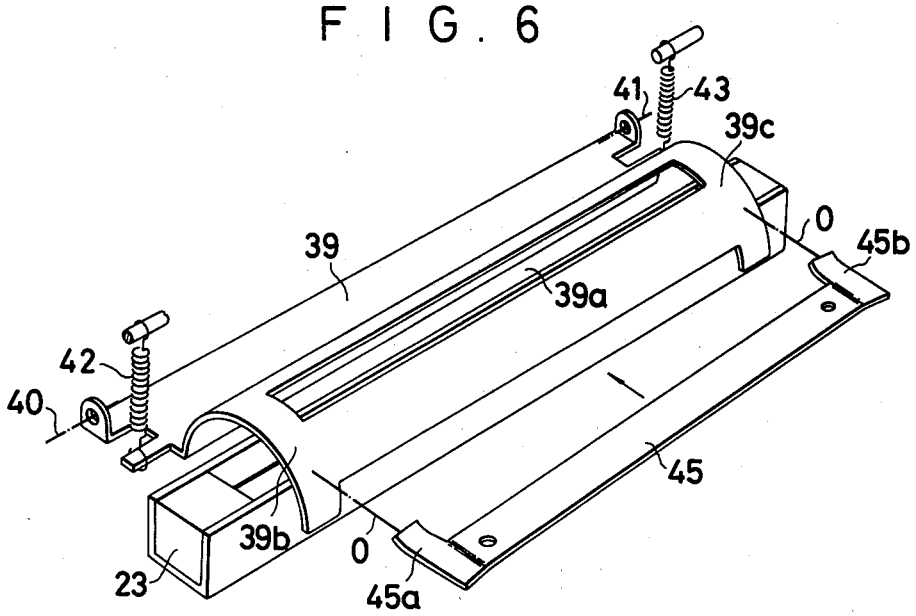
FIG. 6 is a perspective view of another embodiment of the invention.
Figure 7:
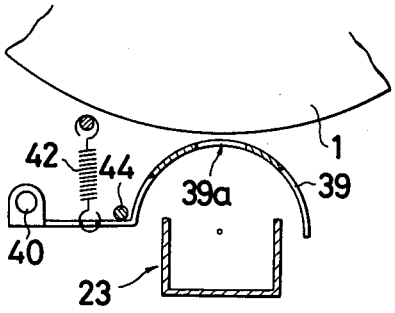
FIG. 7 is a front view, partly in section, of the apparatus shown in FIG. 6.
Figure 8:
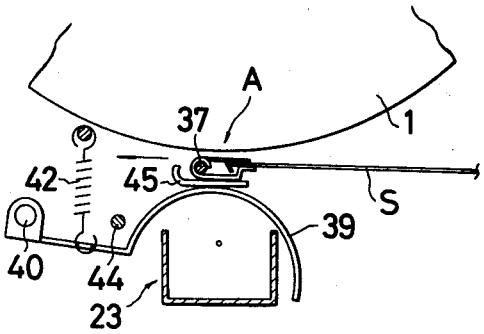
FIG. 8 is a similar view to FIG. 7, illustrating the operation of the apparatus.

In the embodiment described above, one pair of pivotally mounted diaphragm members have been used, but equivalent means may be formed as an integral unit. Referring to FIGS. 6 to 8, there is shown a diaphragm member 39 having a slit 39*a* formed therein which defines the opening of the transfer charger. The diaphragm member 39 includes a horizontal portion which is pivotally mounted on pins 40, 41 secured to a stationary member, not shown, and which is urged to move toward the drum 1 by the resilience of springs 42, 43. The resulting movement of the diaphragm member 39 is limited, by the abutment thereof against a stop 44, to a position where the slit 39*a* is most close to the drum surface. The slit 39*a* is formed in the top of an arcuate or semi-circular portion which is contiguous and extending from the horizontal portion of the diaphragm member, and the arcuate portion includes a pair of end regions 39*b*, 39*c* which are located on the path of movement 0 of a pair of cams 45*a*, 45*b* of a cam plate 45 which is secured to the underside of a sheet gripper 37. In this manner, the end regions 39*b*, 39*c* of the diaphragm member 39 functions as a cam follower cooperating with the moving sheet gripper 37. It is to be understood that the end regions 39*b*, 39*c* are located out of interaction with the drum and free from the influence of the corona discharge applied from the transfer charger 23 to the sheet.

When the sheet gripper 37 has moved into the transfer station A as shown in FIG. 8, the cams 45*a*, 45*b* engage the opposite end regions 39*b*, 39*c* of the diaphragm member 39 to drive it toward the transfer charger against the bias, thus increasing the spacing between the drum and diaphragm member 39. After the sheet gripper 37 has moved past the transfer station and the diaphragm member 39 is disengaged from the cam plate 49, the diaphragm member 39 returns to its original position shown in FIG. 7 where the slit 39*a* is located close to the photosensitive member. It will be understood that the horizontal portion and the semi-circular portion of the diaphragm 39 may be formed as separate elements.

Figure 9:
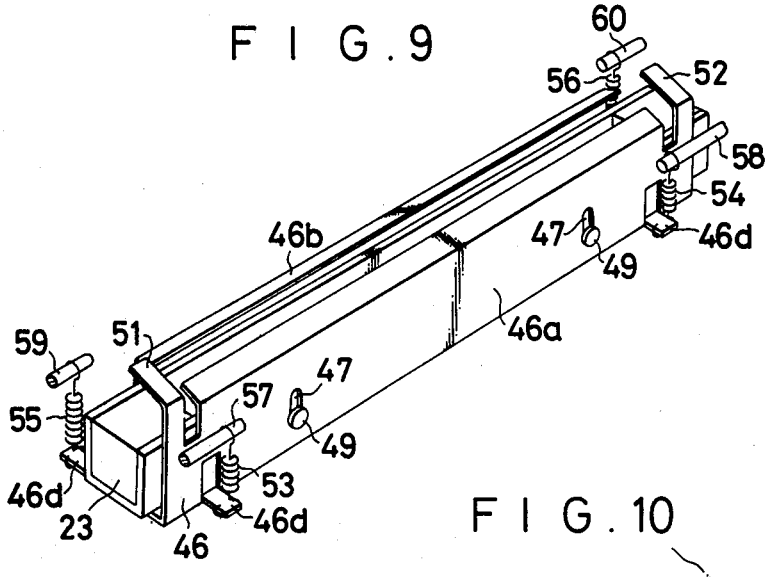
FIG. 9 is a perspective view of still another embodiment of the invention.
Figure 10:
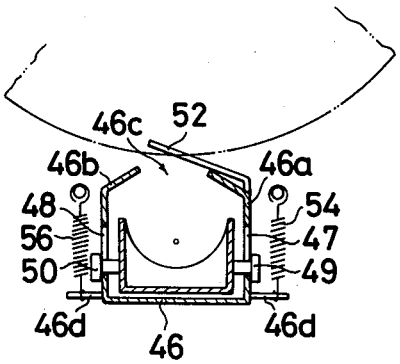
FIG. 10 is a front view, partly in section, of the apparatus shown in FIG. 9.
Figure 11:
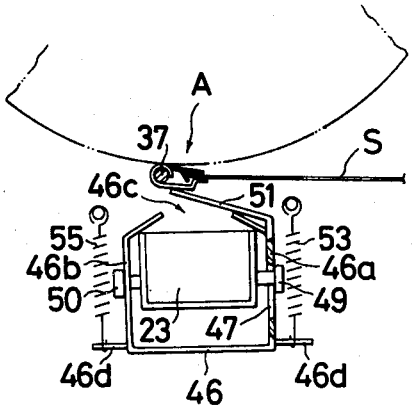
FIG. 11 is a similar to FIG. 10, illustrating the operation thereof.

In the embodiments shown in FIGS. 3 and 6, the diaphragm members or member is rocked to change the spacing between it and photosensitive member during the translational movement of the sheet gripper, but the movement of the diaphragm member is not limited to a rocking motion, but it may be disposed to be movable in a direction substantially perpendicular to the direction of travel of the sheet gripper and parallel to the photosensitive member. Referring to FIGS. 9 to 11, a diaphragm member 46 is disposed so as to surround the transfer charger 23. The diaphragm member 46 has opposing edges which define a slit 46*c* therebetween. The front and rear side plates 46*a*, 46*b* of the diaphragm member 46 are formed with elongate slots 47, 48 which are engaged by a pair of guide pins 49, 50, respectively, which are fixedly mounted on the shield casing of the transfer charger, thus making it movable in the vertical direction relative to the transfer charger, or in a direction to move the slit 46*c* toward or away from the photosensitive member. At its opposite ends, the rear side plate 46*a* of the diaphragm member 46 is formed with folded pieces 51, 52 which serve as cam followers. It is to be noted that the upper end of the folded pieces 51, 52 is located uppermost of the diaphragm member. The diaphragm member 46 is biased to urge the slit 46*c* toward the photosensitive member by means of tension springs 53, 54, 55, 56 which have their one end anchored to tabs 46*d* extending from the opposite side plates 46*a*, 46*b* and having their other end anchored to pins 57 to 60 which are fixedly mounted on a stionary member, not shown. It will be seen that the spacing between the slit and the photosensitive member is determined by the location of the guide pins 49, 50 within the elongate slots 47, 48.

When the sheet gripper 37 which carries the sheet S moves into the transfer station A as shown in FIG. 11, it bears against the folded pieces 51, 52 to lower the diaphragm member 46 against the bias applied thereto. However, after the passage of the sheet gripper 37, the resilience of the springs 53 and 56 causes the diaphragm member 46 to return to its original position shown in FIG. 10 where the slit 46*c* is located close to the photosensitive member.

Figure 12:
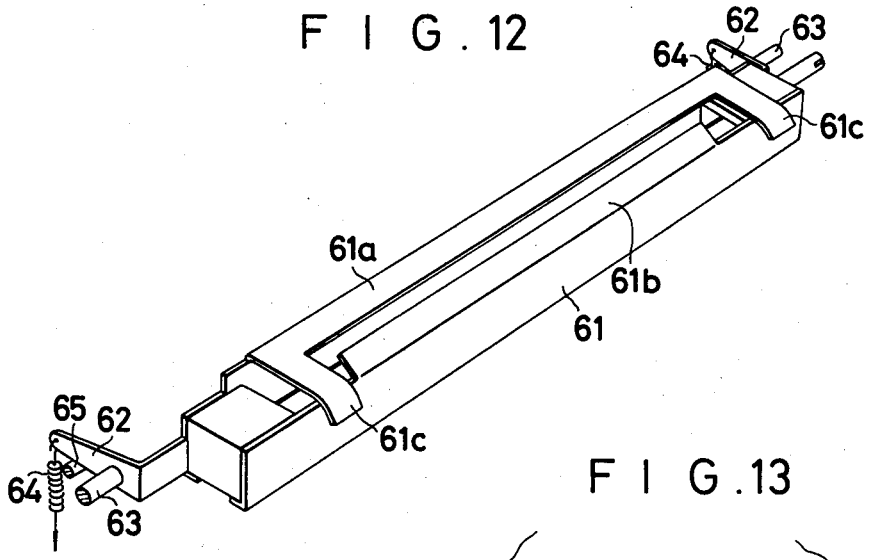
FIG. 12 is a perspective view of a further embodiment of the invention.
Figure 13:
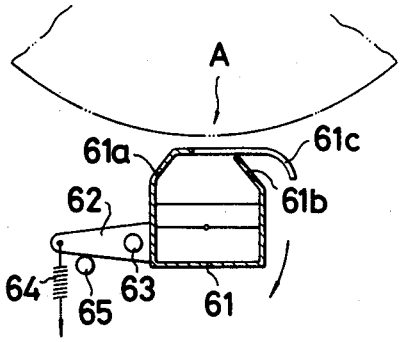
FIG. 13 is a front view, partly in section, of the apparatus shown in FIG. 12.

In the described embodiments, a diaphragm member has been moved to increase the spacing between the photosensitive member and transfer charger, but it should be understood that the transfer charger itself may be moved or the shield casing for the transfer charger may be moved alone. Describing such construction with reference to FIGS. 12 and 13, there is shown a transfer charger 61 which is integrally formed with a pair of diaphragm members 61*a*, 61*b*. The opposite ends of the diaphragm member 61*a* is formed with a pair of cam followers 61*c* in the similar manner as those provided on the end 39*b*, 39*c* shown in FIG. 6. At its opposite ends, the transfer charger 61 is integrally formed with a pair of support arms 62, which are pivotally mounted on pins 63. The free end of the support arms 62 is engaged by a tension spring 64, which urges the transfer charger 61 to rotate in a direction toward the photosensitive member. However, the resulting rotation is limited by abutment of the arm 62 against a stop 65. When the sheet gripper, not shown, moves into the transfer station A, the abutment of the gripper against the cam followers 61*c* causes the entire transfer charger 61 to rock in a direction indicated by an arrow (see FIG. 13) against the resilience of the spring 64, thus increasing the spacing between it and the photosensitive member to permit the passage of the gripper therethrough. After the passage of the sheet gripper, the spring 64 returns the transfer charger to its original position.

Figure 14:
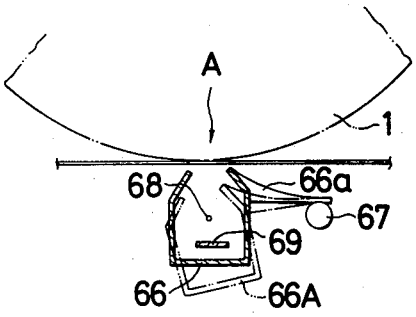
FIG. 14 is a perspective view of an additional embodiment of the invention.

In a modification shown in FIG. 14, the transfer charger has a shield casing 66 which is rotatably mounted on a pin 67 by means of an arm 66*a* and which is biased to rotate clockwise by means, not shown. An electrode 68 is supported by a stationary member 69. A movement of a sheet gripper, not shown, into the transfer station causes it to bear against the arm 66*a* to rock the casing 66 counterclockwise as indicated by phantom line 66A. After the passage of the sheet gripper, the shield casing returns to its original position. It will be understood that the casing 66 is maintained at such position by abutment against a stop, not shown.

Figure 15:
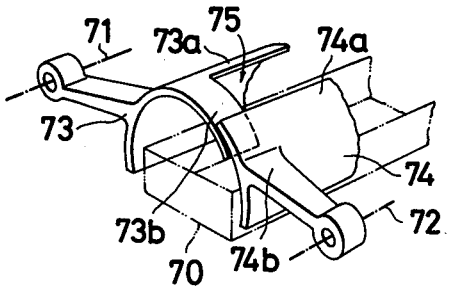
FIG. 15 is a fragmentary perspective view of still further embodiment of the invention.
Figure 16:
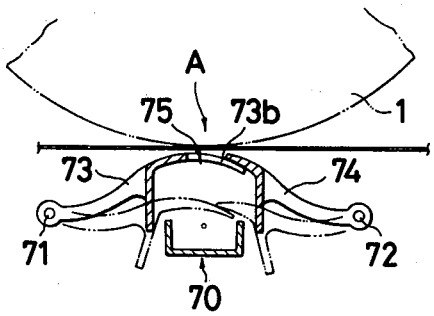
FIG. 16 is a front view, partly in section, of the embodiment shown in FIG. 15.

In a further modification shown in FIGS. 15 and 16, a transfer charger 70 is associated with a pair of diaphragm members 73, 74 which are disposed forwardly and rearwardly thereof and which are pivotally mounted on pins 71, 72. The opposing edges 73*a*, 74*a* of the members 73, 74 define a slit 75 therebetween. The member 74 has an arm 74*b*, the upper surface of which serves as a cam follower and thus is located on the path of movement of a sheet gripper, not shown. The diaphragm member 73 is formed with an extension 73*b* which extends below the cam follower, so that as a sheet gripper, not shown, moves into the transfer station A, it bears against the arm 74*b* of the diaphragm member 74 to rock the diaphragm members 73, 74 away from the drum 1 to a position shown in phantom line in FIG. 16. However, when the sheet gripper is disengaged from the arm 74*b*, the diaphragm member 74 initially rocks to its original position, followed by its disengagement from the extension 73*b* to permit the returning movement of the diaphragm member 73 to its original position. It should be understood that both the diaphragm members 73, 74 are biased to move toward the photosensitive member, by means not shown.

What is claimed is:

1. A transfer apparatus for use in a copying machine of the type in which a toner image formed on a photosensitive member is transferred onto a sheet and employing a sheet gripper, the apparatus comprising a diaphragm means for restricting an opening of a transfer charger and disposed between the transfer charger and the photosensitive means, the diaphragm member being spaced away from and movable away from the photosensitive member as the sheet gripper passes between the transfer charger and the photosensitive member.

2. A transfer apparatus according to claim 1 in which the diaphragm means is mounted on a transfer charger in a manner to be movable toward or away therefrom.

3. A transfer apparatus according to claim 1 in which the diaphragm means comprises a pair of elements which extend parallel to the length of the transfer charger and which are separate from a shield casing of the transfer charger.

4. A transfer apparatus according to claim 1 in which the diaphragm means is substantially integral with the transfer charger.

5. A transfer apparatus according to claim 1 in which the diaphragm means is substantially integral with a shield casing of the transfer charger and is separate from a stationary electrode of the transfer charger.

6. A transfer apparatus according to claim 3 in which the elements of the diaphragm means are pivotally mounted on a pin so as to be movable between the photosensitive member and the transfer charger and is urged to move toward the photosensitive member.

7. A transfer apparatus according to claim 3 in which one of the elements of the diaphragm means which is located upstream with respect to the other element as viewed in the direction of travel of the sheet gripper has its end disposed in overlying relationship with the other element of the diaphragm member.

8. A transfer apparatus according to claim 4 in which the ends of the diaphragm means are formed as cam followers which are adapted to be engaged by the sheet gripper.

9. A transfer apparatus according to claim 5 in which the diaphragm means and the shield casing are supported by a rockable arm.

10. A transfer apparatus for use in a copying machine of the type in which a toner image formed on a photosensitive member is transferred onto a sheet and employing a sheet gripper, the apparatus comprising a diaphragm member for restricting an opening of a transfer charger and disposed between the transfer charger and the photosensitive member, the diaphragm member being spaced away from and movable further away from the photosensitive member as the sheet gripper passes between the transfer charger and the photosensitive member, in which the opposite ends of the diaphragm member are formed as cams which are adapted to be engaged by a sheet gripper.

11. A transfer apparatus for use in a copying machine of the type in which a toner image formed on a photosensitive member is transferred onto a sheet and employing a sheet gripper, the apparatus comprising a diaphragm member for restricting an opening of a transfer charger and disposed between the transfer charger and the photosensitive member, the diaphragm member being spaced away from and movable further away from the photosensitive member as the sheet gripper passes between the transfer charger and the photosensitive member, in which the diaphragm member comprises a single member having an opening formed therein and which is separate from the transfer charger.

12. A transfer apparatus according to claim 11 in which the diaphragm member is rockable to move the opening thereof toward or away from the photosensitive member.

13. A transfer apparatus according to claim 11 in which the diaphragm member is movable toward or away from the photosensitive member while maintaining a parallel relationship with the latter.

14. A transfer apparatus for use in a copying machine of the type in which a toner image formed on a photosensitive member is transferred onto a sheet and employing a sheet gripper, the apparatus comprising a diaphragm member for restricting an opening of a transfer charger and disposed between the transfer charger and the photosensitive member, the diaphragm member being spaced away from and movable further away from the photosensitive member as the sheet gripper passes between the transfer charger and the photosensitive member, in which the diaphragm member comprises a pair of elements which extend parallel to the length of the transfer charger and which are separate from a shield casing of the transfer charger, and in which the elements of the diaphragm member are pivotally mounted on a pin so as to be movable between the photosensitive member and the transfer charger and are urged to move toward the photosensitive member.

15. A transfer apparatus for use in a copying machine of the type in which a toner image formed on a photosensitive member is transferred onto a sheet and employing a sheet gripper, the apparatus comprising a diaphragm member for restricting an opening of a transfer charger and disposed between the transfer charger and the photosensitive member, the diaphragm member being spaced away from and movable further away from the photosensitive member as the sheet gripper passes between the transfer charger and the photosensitive member, in which the diaphragm member comprises a pair of elements which extend parallel to the length of the transfer charger and which are separate from a shield casing of the transfer charger, and in which the respective elements of the diaphragm member have their one side disposed in abutment against a shield casing of the transfer charger by gravity.

16. A transfer apparatus for use in a copying machine of the type in which a toner image formed on a photosensitive member is transferred onto a sheet and employing a sheet gripper, the apparatus comprising a diaphragm member for restricting an opening of a transfer charger and disposed between the transfer charger and the photosensitive member, the diaphragm member being spaced away from and movable further away from the photosensitive member as the sheet gripper passes between the transfer charger and the photosensitive member, in which the diaphragm member comprises a pair of elements which extend parallel to the length of the transfer charger and which are separate from a shield casing of the transfer charger, and in which the respective elements of the diaphragm member are rockably mounted on a common support shaft.

17. A transfer apparatus according to claim 16 in which the support shaft is carried by one end of a lever which is urged to rock in a direction to move the shaft toward the photosensitive member.

18. A transfer apparatus according to claim 17 in which a stop is provided to limit the extent of rocking motion of the lever.

19. A transfer apparatus according to claim 17 in which one end of the lever is formed as a cam which is adapted to be engaged by the sheet gripper.

20. A transfer apparatus for use in a copying machine of the type in which a toner image formed on a photosensitive member is transferred onto a sheet and employing a sheet gripper, the apparatus comprising a diaphragm member for restricting an opening of a transfer charger and disposed between the transfer charger and the photosensitive member, the diaphragm member being spaced away from and movable further away from the photosensitive member as the sheet gripper passes between the transfer charger and the photosensitive member, in which the diaphragm member is substantially integral with the transfer charger, and in which the transfer charger is rockable so as to move the opening thereof toward or away from the photosensitive member.

21. A transfer apparatus for use in a copying machine of the type in which a toner image formed on a photosensitive member is transferred onto a sheet and employing a sheet gripper, the apparatus comprising a diaphragm member for restricting an opening of a transfer charger and disposed between the transfer charger and the photosensitive member, the diaphragm member being spaced away from and movable further away from the photosensitive member as the sheet gripper passes between the transfer charger and the photosensitive member, in which the diaphragm member is substantially integral with the transfer charger and in which the ends of the diaphragm member are formed as cam follower which are adapted to be engaged by the sheet gripper.

22. A transfer apparatus for use in a copying machine of the type in which a toner image formed on a photosensitive member is transferred onto a sheet and employing a sheet gripper, the apparatus comprising a diaphragm member for restricting an opening of a transfer charger and disposed between the transfer charger and the photosensitive member, the diaphragm member being spaced away from and movable further away from the photosensitive member as the sheet gripper passes between the transfer charger and the photosensitive member, in which the diaphragm member is substantially integral with the transfer charger and in which the support shaft is carried by one end of a lever which is urged to rock in a direction to move the shaft toward the photosensitive member.

23. A transfer apparatus according to claim 22 in which the arm is formed as a cam follower which is adapted to be engaged by the sheet gripper.

24. In a photocopying machine in which an image of an original to be copied is transferred to the surface of a moving photosensitive member which includes a transfer charger adjacent to but spaced from the photosensitive member and having an opening directed toward the photosensitive member, the improvement comprising a copy sheet gripper engageable with a copy sheet for feeding it along a feed path between photosensitive member and the transfer charger, a diaphragm member spaced away from the photosensitive member and engageable over the opening of the transfer charger for restricting the opening thereof, and diaphragm member supporting means supporting said diaphragm between the photosensitive member and the transfer charger and disposed away from the photosensitive member in the path of movement of said copy sheet gripper and being displaceable by said copy sheet gripper as it moves thereby toward the transfer charger so as to position it to provide a selected restriction of the opening during passage of said copy sheet gripper between said photosensitive member and the transfer charger.

25. In a photocopying machine according to claim 24 wherein said diaphragm member supporting means comprises a lever member pivotally mounted alongside the transfer charger and having a follower portion disposed in the path of movement of said copy sheet gripper.

26. In a photocopying machine according to claim 25 including spring means biasing said lever member in a direction to move said follower portion toward said photosensitive member into the path of movement of said gripper said diaphragm member comprising first and second diaphragms having a lever arm portion connected to and pivotally connected to the end of said lever member.

* * * * *